US006450822B1

(12) United States Patent
Eller

(10) Patent No.: US 6,450,822 B1
(45) Date of Patent: Sep. 17, 2002

(54) SYSTEM AND METHOD FOR ELECTRICALLY AND MECHANICALLY COUPLING AN AVIONICS LINE REPLACEABLE UNIT WITH ELECTRONIC EQUIPMENT

(75) Inventor: Roger D. Eller, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/323,196

(22) Filed: Jun. 1, 1999

(51) Int. Cl.[7] ..... H01R 13/64
(52) U.S. Cl. ..... 439/248; 439/247
(58) Field of Search ..... 439/247, 248, 439/246, 6, 61; 324/760, 158.1, 73.1

(56) References Cited

U.S. PATENT DOCUMENTS 4,075,444 A * 2/1978 Hollingsead et al. ... 439/252 X
4,236,190 A * 11/1980 Hollingsead et al. ..... 361/391
4,921,435 A * 5/1990 Kane et al. ..... 439/248
5,318,455 A * 6/1994 Villiers et al. ..... 439/248
5,344,332 A * 9/1994 Lopez et al. ..... 439/248
5,552,959 A * 9/1996 Penniman et al. ..... 361/686
5,930,428 A * 7/1999 Irwin et al. ..... 385/88
5,947,753 A * 9/1999 Chapman et al. ..... 439/79

* cited by examiner

*Primary Examiner*—Brian Sircus
*Assistant Examiner*—Son V. Nguyen
(74) *Attorney, Agent, or Firm*—Nathan O. Jensen; Kyle Eppele

(57) ABSTRACT

An avionics LRU which is coupled to an avionics rack and/or mounting tray on an aircraft or a test station through a floating connector. The floating connection allows for reduced stress and strain on the pins and sockets in the connector during blind mating of the LRU to the rack or mounting tray or test station.

15 Claims, 5 Drawing Sheets

SYSTEM AND METHOD FOR ELECTRICALLY AND MECHANICALLY COUPLING AN AVIONICS LINE REPLACEABLE UNIT WITH ELECTRONIC EQUIPMENT

CROSS REFERENCE TO RELATED PATENT APPLICATIONS

The present application is related to co-pending patent application entitled System And Method For Electrically Coupling An Avionics Line Replaceable Unit With An Avionics Test Station filed on even date herewith by the same inventor and assigned to the same assignee. This application is incorporated herein in its entirety by this reference.

FIELD OF THE INVENTION

The present invention generally relates to aviation electronics or avionics, and more particularly relates to line replaceable units (LRUs) of avionics equipment which are mated to a rack and/or mounting tray in an aircraft, and even more particularly relates to a system and method for electrically and mechanically coupling such LRUs with other electronic equipment.

BACKGROUND OF THE INVENTION

In the past, designers of avionics systems have endeavored to provide systems with improved reliability and improved serviceability. One crucial element in such systems has been the use of line replaceable units which can be quickly removed from the aircraft upon any failure or for routine maintenance. These line replaceable units may be replaced with a spare line replaceable unit or tested on a test station and repaired. These test stations are typically very versatile, being capable of testing various different types of avionics equipment. The versatility of these test stations arises out of the use of various test unit adapters (TUAs), which are tailored to electrically connect various avionics LRUs with the test station.

While these line replaceable units, test stations and TUAs have many advantages, they also have significant drawbacks.

First of all, these line replaceable units are usually blind mated with connectors in an avionics rack on the aircraft or with the TUAs. When these line replaceable units are mated with such connectors, the connectors typically provide both electrical and mechanical coupling. In fact, due to positional tolerance issues, the line replaceable units are held suspended only by these connectors. This required misalignment and subsequent suspension of line replaceable units results in undesirable stress and strain being placed upon the electrical connection contacts.

Secondly, when the line replaceable units are mated to a TUA in a test station (which have generally much larger tolerances than airborne avionics equipment) the amount of uncertainty of alignment increases, thereby increasing the likelihood of pin damage resulting from improper alignment upon mating.

Consequently, there exists a need for improvement in avionics systems and methods for coupling LRUs to such systems.

SUMMARY OF THE INVENTION

It is an object of the present invention to provide enhanced reliability for avionics LRUs.

It is a feature of the present invention to utilize an LRU with a floatable connector interface.

It is an advantage of the present invention to allow the LRU to be mated without a suspended alignment approach to the connector.

It is another advantage of the present invention to decrease the potential for pin damage upon insertion.

The present invention is an apparatus and method for mating avionics LRUs with other electronic equipment, which is designed to satisfy the aforementioned needs, provide the previously stated objects, include the above-listed features and achieve the already articulated advantages. The present invention is carried out with a "suspension-less LRU" in a sense that the amount of mechanical suspension by the connector has been greatly reduced.

Accordingly, the present invention is a system and method for mating avionics LRUs with other electronic equipment where the system includes a floatable electrical connector, and the method includes placing the LRU on a rest, sliding it into position without raising the LRU above the rest.

BRIEF DESCRIPTION OF THE DRAWINGS

The invention may be more fully understood by reading the following description of the preferred embodiments of the invention, in conjunction with the appended drawings wherein.

DETAILED DESCRIPTION

Figure 1:
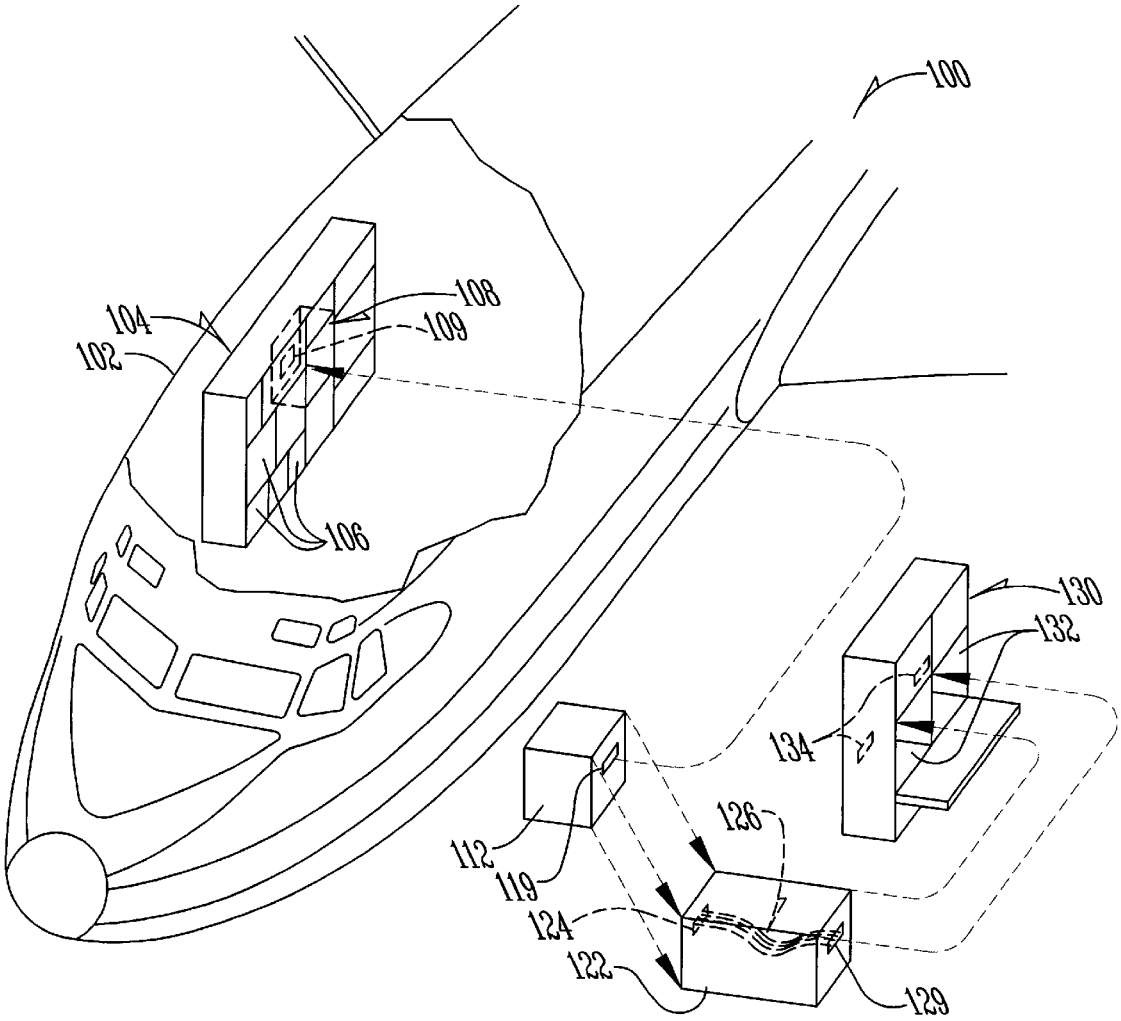
FIG. 1 (PRIOR ART)
FIG. 1 is a simplified exploded diagram of a system and environment of the prior art, where the dotted and dashed lines show the orientation of objects when in an assembled state.

Now referring to the drawings, wherein like numerals refer to like matter throughout, and more particularly to FIG. 1, there is shown a system of the prior art, generally designated 100, which includes in an aircraft 102, an on-board avionics rack 104, with several avionics line replaceable units 106 disposed therein. On-board avionics rack or mounting tray 104 is shown having an unoccupied slot 108 therein with an on-board rack mounted rack/LRU connector interface 109 disposed at its inside end. Non-installed avionics line replaceable unit 112 is shown removed from unoccupied slot 108 and is shown having an avionics line replaceable unit rear blind mating connector interface 119 for coupling with on-board rack mounted rack/LRU connector 109. On-board rack mounted rack/LRU connector 109 and avionics line replaceable unit rear blind mating connector interface 119 are often, but are not necessarily, of a standardized design set by aviation standard setting body ARINC. Also shown in FIG. 1 is hand-wired TUA 122 having a TUA/LRU connector 124, a TUA/test station connector interface 129 and hand-wired interconnection wires 126 disposed therebetween. Hand-wired TUA 122 is shown as removed from one of two TUA docking stations 132 of test station 130. Each TUA docking station 132 has a test station/TUA connector interface 134 therein for coupling with TUA/test station connector interface 129 of hand-wired TUA 122. TUA/LRU connector 124 may be of similar or identical design to on-board rack mounted rack/LRU connector 109 and consequently, TUA/LRU connector 124 is capable of receiving avionics line replaceable unit rear blind mating connector interface 119 of non-installed avionics line replaceable unit 112.

Figure 2:
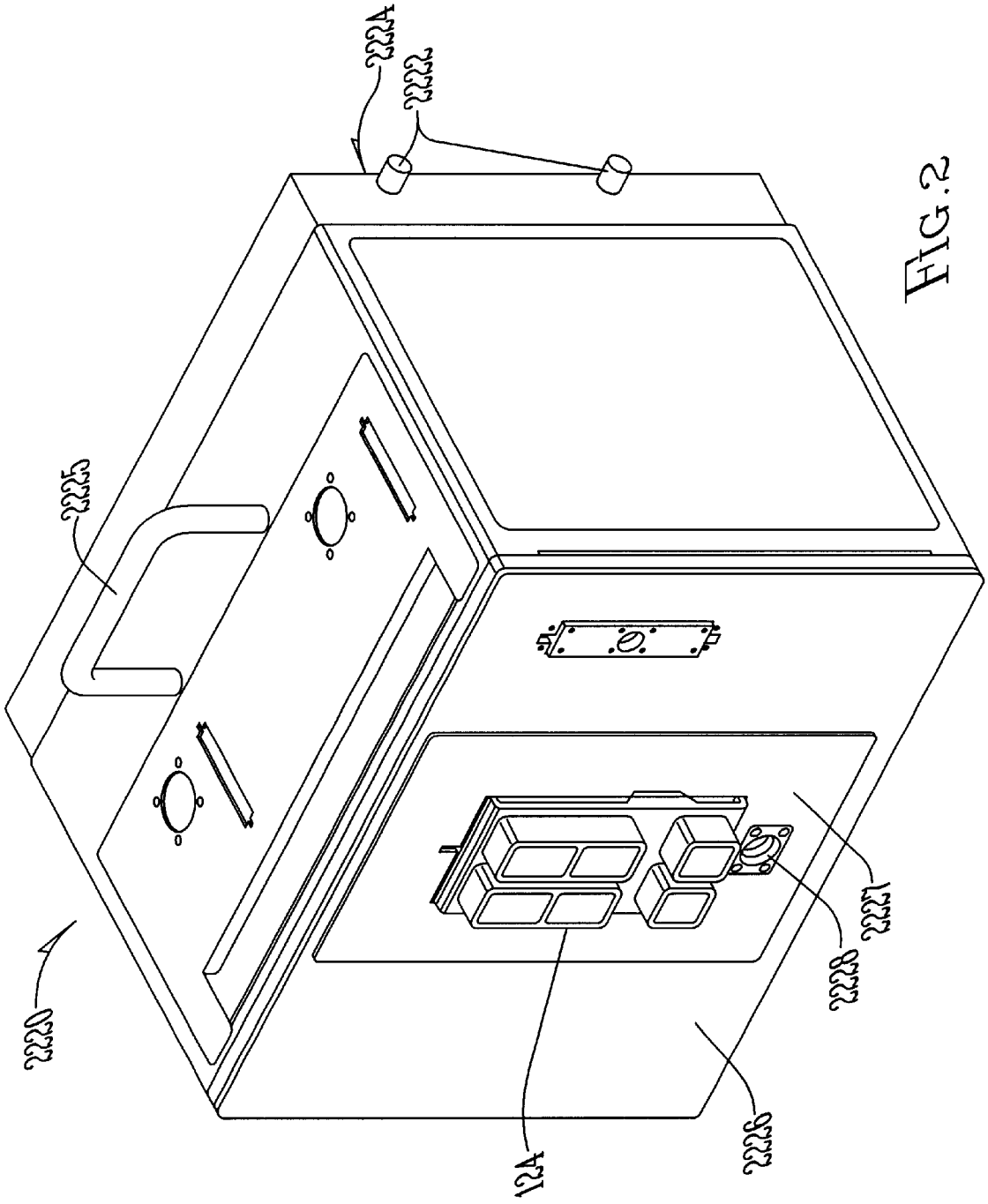
FIG. 2 is a perspective view of an LRU side of a TUA having a floating connector.

Now referring to FIG. 2, there is shown a perspective view of the TUA 2220, having docking station locking pins 2222, test station side 2224, TUA handle 2225, and LRU front 2226. TUA 2220 also shows an avionics line replaceable unit TUA/LRU connector 124 disposed on floating connector plate 2227 on LRU front 2226. Shown on floating connector plate 2227 is a floating connector plate alignment hole 2228. Avionics line replaceable unit TUA/LRU connector 124 may be an ARINC connector or any other type of multi-pin connector which can perform the necessary interface functions.

Figure 3:
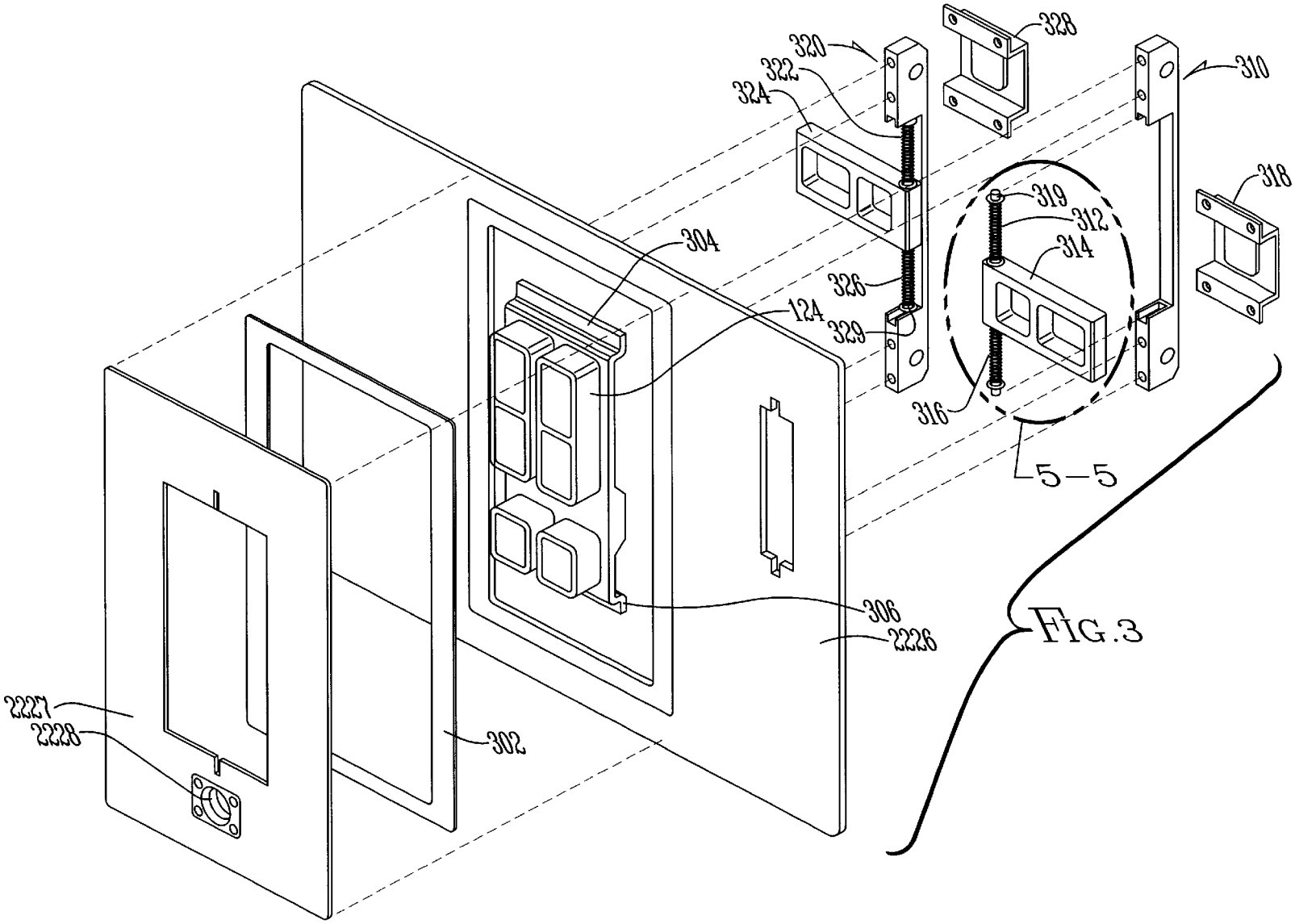
FIG. 3 is an exploded perspective view of an LRU side of a TUA, where the dotted and dashed lines show the orientation of objects when in an assembled state.

Now referring to FIG. 3, there is shown an exploded perspective view of portions of the present invention, including a first Teflon isolator 302 (shown exploded) attached to LRU front 2226 and a second Teflon isolator (not shown) is attached to floating connector plate 2227. Also shown is a first vertical axis race assembly 310 for coupling with floating connector plate 2227 to provide an axis link to LRU front 2226. First vertical axis race assembly 310 includes a first top station spring 312, a first vertical axis controlling bracket 314, and a first bottom station spring 316 all disposed along a first vertical bearing race 319. First vertical axis controlling bracket 314 in combination with a first stop retainer 318 is provided to limit the horizontal and rotational float of first vertical axis race assembly 310. A second vertical axis race assembly 320, which may be preferably similar or identical to first vertical axis race assembly 310 in function and construction, is also shown. Second vertical axis race assembly 320 includes a second top station spring 322, a second vertical axis controlling bracket 324 and a second bottom station spring 326, as well as a second stop retainer 328 and a second vertical bearing race 329

TUA/LRU connector 124 is coupled to floating connector plate 2227 through top and bottom mounting flanges 304 and 306 respectively.

Figure 4:
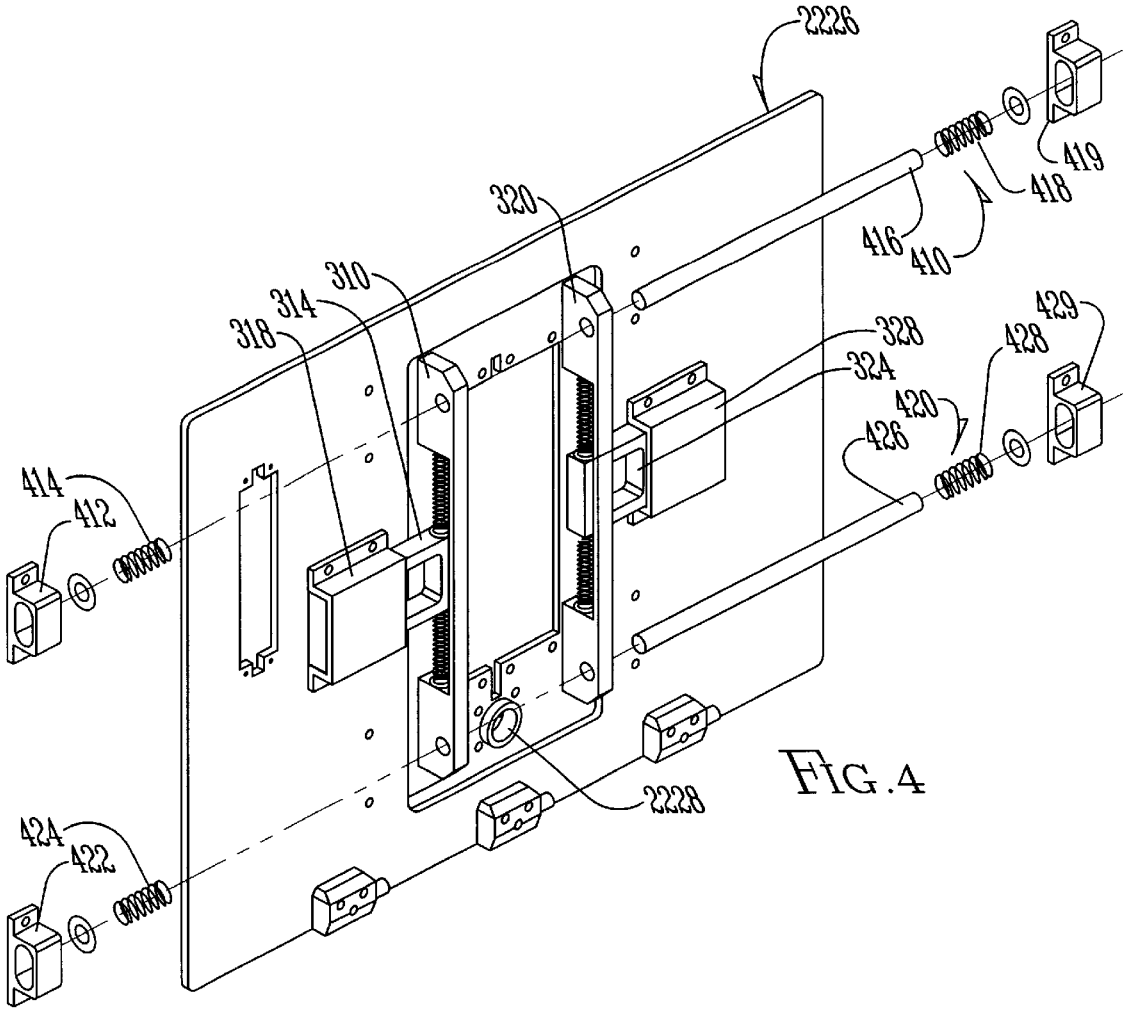
FIG. 4 is an enlarged perspective view of an opposite side of an LRU side of a TUA of FIG. 2.

Now referring to FIG. 4, there is shown additional portions of the present invention, including top horizontal axis assembly 410 and horizontal axis assembly 420, which provides and controls horizontal float of the avionics line replaceable unit TUA/LRU connector 124. Top horizontal axis assembly 410 includes first top vertical float stop 412, first top station spring 414, top horizontal race 416, second top station spring 418 and second top vertical float stop 419. Top horizontal race 416 extends through first vertical axis race assembly 310 and second vertical axis race assembly 320. In a similar fashion, there is shown bottom horizontal axis assembly 420, which includes first bottom vertical float stop 422, first bottom station spring 424, bottom horizontal race 426, second bottom station spring 428, and second bottom vertical float stop 429.

Figure 5:
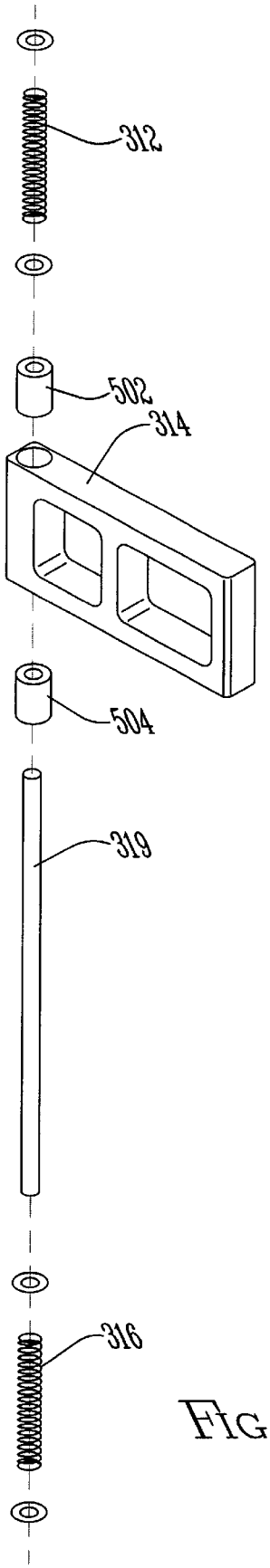
FIG. 5 is an enlarged and exploded perspective view of an encircled area of FIG. 3.

Now referring to FIG. 5, there is shown an enlarged exploded perspective view of portions of first vertical axis race assembly 310 shown in the encircled area of FIG. 3 labeled 5. A first vertical bearing race 319 is shown centrally disposed in first vertical axis race assembly 310. First vertical bearing race 319 may be similar or identical to second vertical bearing race 329. Disposed about first vertical bearing race 319 is top linear bearing 502 and bottom linear bearing 504.

In operation, an avionics line replaceable unit TUA/LRU connector 124 can be floatably mounted to an on-board avionics rack 104 or a TUA 2220 for receiving an avionics line replaceable unit 106 having an avionics line replaceable unit rear blind mating connector interface 119 thereon. The floatability of TUA/LRU connector 124 allows for many benefits. First of all, an LRU can be placed in an on-board avionics rack 104 or test station 130 and slid into place. As the avionics line replaceable unit rear blind mating connector interface 119 meets with the TUA/LRU connector 124, the TUA/LRU connector 124 is allowed to float to a new position, preferably sufficiently low enough so that the LRU can be mated without raising the LRU off the rest. This reduces stress and strain upon the contacts in avionics line replaceable unit rear blind mating connector interface 119 and/or TUA/LRU connector 124. Preferably the float of the TUA/LRU connector 124 is in at least two directions and has sufficient float to accommodate the potential misalignment of avionics line replaceable unit rear blind mating connector interface 119 and TUA/LRU connector 124. Often the tolerances for TUA/test station combinations are higher than tolerances for LRUs. When this is the case, the potential amount of misalignment is greater. An alignment shaft may be attached to the LRU, or more preferably to a receiving apparatus used on the test station 130. This alignment shaft cooperates with floating connector plate alignment hole 2228 to pre-align the avionics line replaceable unit rear blind mating connector interface 119 and the 124 to accommodate for these higher tolerances. Preferably, the floatability of TUA/LRU connector 124 allows for mating without a requirement to raise the LRU off the rest and, therefore, without the need to mechanically suspend the LRU by the avionics line replaceable unit rear blind mating connector interface 119 and TUA/LRU connector 124 combination.

Horizontal float and float limitation are accomplished by top horizontal axis assembly 410 and horizontal axis assembly 420 which permits a horizontal translation of first vertical axis race assembly 310 and second vertical axis race assembly 320 along top horizontal race 416. Horizontal float is limited by first vertical axis controlling bracket 314 and second vertical axis controlling bracket 324 in cooperation with second vertical float stop bracket 328 and first vertical float stop bracket 318 determined by their relative feature of size allocations.

Vertical float and float limitation are accomplished by first vertical axis race assembly 310 and second vertical axis race assembly 320 which permit vertical translation of top horizontal axis assembly 410 and horizontal axis assembly 420 along first vertical bearing race 319 and second vertical bearing race 329. Vertical float is limited by first top vertical float stop 412 and second top vertical float stop 419, as well as first bottom vertical float stop 422 and second bottom horizontal float stop 429.

Rotational float and float limitation are accomplished by rounding ends of top horizontal race 416, and bottom horizontal race 426 and the features of size correlation of first vertical axis controlling bracket 314 to first vertical float stop bracket 318 and second vertical axis controlling bracket 324 to second vertical float stop bracket 328.

It is thought that the method and apparatus of the present invention will be understood from the foregoing description, and that it will be apparent that various changes may be made in the form, construct steps and arrangement of the parts and steps thereof, without departing from the spirit and scope of the invention or sacrificing all of their material advantages. The form herein described is merely a preferred exemplary embodiment thereof.

I claim:

1. An avionics system comprising:

an avionics (line replaceable unit), of a type having a first connector thereon;

a second connector, for coupling with said first connector;

said second connector coupled to a structural member, but having a floating characteristic which permits said second connector to move with respect to said structural member, when said first connector is brought into contact with said second connector;

wherein said floating characteristic has freedom of movement in at least two orthogonal directions, and further including rotational motion about an axis extending parallel to a plane of interface between said first connector and said second connector; and wherein said second connector is coupled to said structural member with a plurality of rods, each of said plurality of rods being biased by first and second compression springs, disposed to place opposing forces on said second connector, to return said second connector to a central starting point when no connector to connector mating forces are being applied.

2. The avionics system of claim 1 wherein said structural member is a test unit adapter.

3. The avionics system of claim 1 wherein said plurality of spring-loaded rods are oriented in a plurality of orthogonal directions.

4. The avionics system of claim 3 wherein said structural member is an avionics test station test unit adapter.

5. The avionics system of claim 1, wherein each of the first and second compression springs corresponding to one of the plurality of rods are configured to surround the one of the plurality of rods.

6. A system for providing aviation electronics functions comprising:

an avionics line replaceable unit having a first connector thereon;

an avionics rack having an avionics LRU (line replaceable unit) support member and a second connector floatably coupled to said support member;

means for mechanically and electrically coupling said avionics line replaceable unit to said rack via said first connector and said second connector, so that upon contact of said first connector with said second connector, while said avionics line replaceable unit is disposed on said support member, one of said first connector and said second connector is caused to move along a first direction and another of said first connector and said second connector is caused to move in a second direction which is orthogonal to said first direction;

wherein said means for mechanically and electrically coupling includes a plurality of rods that connect said second connector to said structural member, each of said plurality of rods being biased by first and second compression springs, disposed to place opposing forces on said second connector, to return said second connector to a central starting point when no connector to connector mating forces are being applied.

7. The avionics system of claim 6 wherein said line replaceable unit is in contact with said support member after said first connector is mechanically coupled with said second connector.

8. The avionics system of claim 6 wherein said second connector moves in said second direction against a first spring biased opposing force.

9. The avionics system of claim 8 wherein said second connector moves in a third direction which is orthogonal to said first direction and said second direction and motion in said third direction is against a second spring biased opposing force.

10. The system of claim 6, wherein each of the first and second compression springs corresponding to one of the plurality of rods are configured to surround the one of the plurality of rods.

11. A method of coupling an LRU (line replaceable unit) with other electronics equipment, comprising the steps of:

providing an avionics LRU, having a specific weight, with a first connector coupled thereto;

providing a second connector coupled to a structural member having an LRU support surface associated therewith for supporting an avionics LRU;

supporting at least a portion of said specific weight of said avionics LRU by contact of said avionics LRU with said support surface;

moving said avionics LRU along said supporting surface, in a first direction, until contacting said first connector with said second connector; and, continuing moving said avionics LRU in said first direction and thereby generating a relative motion between said first connector and said second connector in a direction which is orthogonal to said first direction, wherein said relative motion is resisted by an opposing force provided by a plurality of compression springs.

12. The method of claim 11 wherein said relative motion results in motion between said second connector and said support surface.

13. The method of claim 12 wherein said first direction is substantially parallel to a top surface of said support surface.

14. The method of claim 13 wherein said LRU remains in contact with said support surface during said step of continuing moving said avionics LRU in said first direction.

15. The method of claim 11, wherein the plurality of compression springs include first and second compression springs that are disposed around a rod, said rod coupling said second connector to said structural member, wherein said first and second compression springs are configured to provide oppositely-directed forces to return said second connector to a central starting point when no connector to connector mating forces are being applied.

* * * * *